US008144015B2

(12) United States Patent
Burket et al.

(10) Patent No.: US 8,144,015 B2
(45) Date of Patent: Mar. 27, 2012

(54) POWER EFFICIENT OBJECT DETECTION WITH SELECTIVE POLLING

(75) Inventors: William Donn Burket, Redmond, WA (US); Shobana Kapoor, Woodinville, WA (US)

(73) Assignee: Microsoft Corporation, Redmond, WA (US)

( * ) Notice: Subject to any disclaimer, the term of this patent is extended or adjusted under 35 U.S.C. 154(b) by 402 days.

(21) Appl. No.: 12/565,396

(22) Filed: Sep. 23, 2009

(65) Prior Publication Data

US 2011/0068923 A1 Mar. 24, 2011

(51) Int. Cl.
*G08B 13/14* (2006.01)

(52) U.S. Cl. ..... 340/572.1; 340/10.1; 340/10.42; 340/571; 340/539.11; 340/539.13; 340/539.15; 340/568.1; 340/573.2

(58) Field of Classification Search ..... 340/10.1, 340/10.42, 539.11, 539.13, 571, 568.1, 573.2, 340/505–506
See application file for complete search history.

(56) References Cited

U.S. PATENT DOCUMENTS

| | | | | |
|---|---|---|---|---|
| 5,886,634 | A * | 3/1999 | Muhme | 340/572.1 |
| 5,936,527 | A * | 8/1999 | Isaacman et al. | 340/572.1 |
| 6,177,905 | B1 * | 1/2001 | Welch | 342/357.75 |
| 6,232,870 | B1 | 5/2001 | Garber et al. | |
| 6,331,817 | B1 * | 12/2001 | Goldberg | 340/573.1 |
| 6,462,660 | B1 * | 10/2002 | Cannon et al. | 340/572.1 |
| 6,720,888 | B2 | 4/2004 | Eagleson et al. | |
| 6,842,121 | B1 * | 1/2005 | Tuttle | 340/693.9 |
| 6,989,749 | B2 * | 1/2006 | Mohr | 340/572.1 |
| 7,064,663 | B2 | 6/2006 | Pucci et al. | |
| 7,187,287 | B2 | 3/2007 | Ryal | |
| 7,205,895 | B2 * | 4/2007 | Outlaw et al. | 340/572.1 |
| 7,212,121 | B2 * | 5/2007 | Hashimoto et al. | 340/572.1 |
| 7,271,715 | B2 * | 9/2007 | Aupperle et al. | 340/539.13 |
| 7,366,522 | B2 * | 4/2008 | Thomas | 455/456.1 |
| 7,583,972 | B2 * | 9/2009 | Clipsham | 455/457 |

(Continued)

FOREIGN PATENT DOCUMENTS

KR 1020080002329 A 1/2008

OTHER PUBLICATIONS

"International Search Report", Mail Date: May 18, 2011, Application No. PCT/US2010/047063, Filed Date; Aug. 28, 2010, pp. 9.

(Continued)

*Primary Examiner* — Daniel Wu
*Assistant Examiner* — Son M Tang

(57) ABSTRACT

Detecting the absence of tagged objects near a computing device and attempting to locate the absent, tagged objects using other computing devices in a power-efficient manner. The computing device is monitored for triggering conditions. Upon occurrence of at least one of the triggering conditions, the computing device polls for the tagged objects expected to be proximate to the computing device. By polling responsive to occurrence of the triggering conditions, power consumption by the computing device is reduced. The triggering conditions include, for example, time-based transitions, movement of the computing device, or a geographic location of the computing device. Upon detecting the absence of at least one of the objects, the computing device, or a web service, identifies other computing devices to which the absent object may be proximate. The other computing devices determine whether the absent object is proximate, and notify the computing device.

20 Claims, 5 Drawing Sheets

U.S. PATENT DOCUMENTS

| | | | | |
|---|---|---|---|---|
| 7,598,855 | B2 * | 10/2009 | Scalisi et al. | 340/539.13 |
| 7,649,454 | B2 * | 1/2010 | Singh et al. | 340/539.11 |
| 7,880,613 | B1 * | 2/2011 | Maeng | 340/572.1 |
| 7,936,736 | B2 * | 5/2011 | Proctor et al. | 370/338 |
| 7,978,082 | B2 * | 7/2011 | Braunstein | 340/573.1 |
| 7,999,669 | B2 * | 8/2011 | Singh et al. | 340/539.11 |
| 2005/0068170 | A1 | 3/2005 | Aupperle et al. | |
| 2005/0083181 | A1 | 4/2005 | Jalkanen et al. | |
| 2005/0237196 | A1 * | 10/2005 | Matsukawa et al. | 340/572.1 |
| 2005/0285731 | A1 * | 12/2005 | Outlaw et al. | 340/539.1 |
| 2006/0087407 | A1 * | 4/2006 | Stewart et al. | 340/10.52 |
| 2007/0052534 | A1 * | 3/2007 | Bird et al. | 340/539.13 |
| 2008/0272896 | A1 | 11/2008 | Adamczyk et al. | |
| 2009/0012667 | A1 | 1/2009 | Matsumoto et al. | |

OTHER PUBLICATIONS

Ni, et al. "LANDMARC: Indoor Location Sensing using Active RFID", Retrieved at <<http://www.cs.ust.hk/~liu/Landmarc.pdf>>, Wireless Networks, Nov. 2004, vol. 10 , Issue 6, pp. 701-710.

Boukraa, et al. "A Knowledge-Based Registration System using Radio-Frequency Identification", Retreived at <<http://b2.cvl.iis.u-tokyo.ac.jp/mva/proceedings/CommemorativeDVD/2002/papers/2002350.pdf>>, IAPR Workshop on Machine Vision Application, Dec. 11-13, 2002, Japan, pp. 350-353.

Frank, et al. "Objects Calling Home: Locating Objects using Mobile Phones", Retrieved at <<http://www.vs.inf.ethz.ch/res/papers/frank07.locating.ps>>, vol. 4480/2007, 2007, Germany, pp. 19.

* cited by examiner

POWER EFFICIENT OBJECT DETECTION WITH SELECTIVE POLLING

BACKGROUND

Existing technologies enable wireless detection of objects near a reader device. For example, the effective range of BLUETOOTH brand devices is about 10 meters, while some radio frequency identification (RFID) readers can detect RFID tags on objects as far as 100 meters away. Various polling schemes have been proposed for the BLUETOOTH brand devices to maintain contact, but the schemes require frequent polling of devices and thus carry a significant power cost. Similarly, some RFID readers frequently poll for the RFID tags to determine whether any of the expected RFID tags are not detected. In such systems, the RFID readers are typically mounted in a fixed array, and each of the RFID readers has a dedicated and continuous power source to satisfy the significant power requirements of the frequent polling.

SUMMARY

Embodiments of the disclosure enable the monitoring of tagged items based on triggering conditions. One or more of the triggering conditions are defined for association with a first computing device. Responsive to an occurrence of at least one of the triggering conditions, the first computing device detects one or more items proximate to the first computing device. The detected items are compared to a list of items intended to be proximate to the first computing device to identify at least one absent item. The absent item is identified to a second computing device that attempts to detect the absent item proximate to the second computing device. The second computing device notifies the first computing device whether the absent item has been detected.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

Corresponding reference characters indicate corresponding parts throughout the drawings.

DETAILED DESCRIPTION

Referring to the figures, embodiments of the disclosure enable, at least, the power-efficient detection and location of missing items or objects. In a system according to some embodiments, objects 104 are selectively polled for presence based on triggering conditions 212 or events to reduce the power consumption of the system. Accordingly, aspects of the disclosure are operable with any computing device, including devices with limited power resources.

Figure 1:
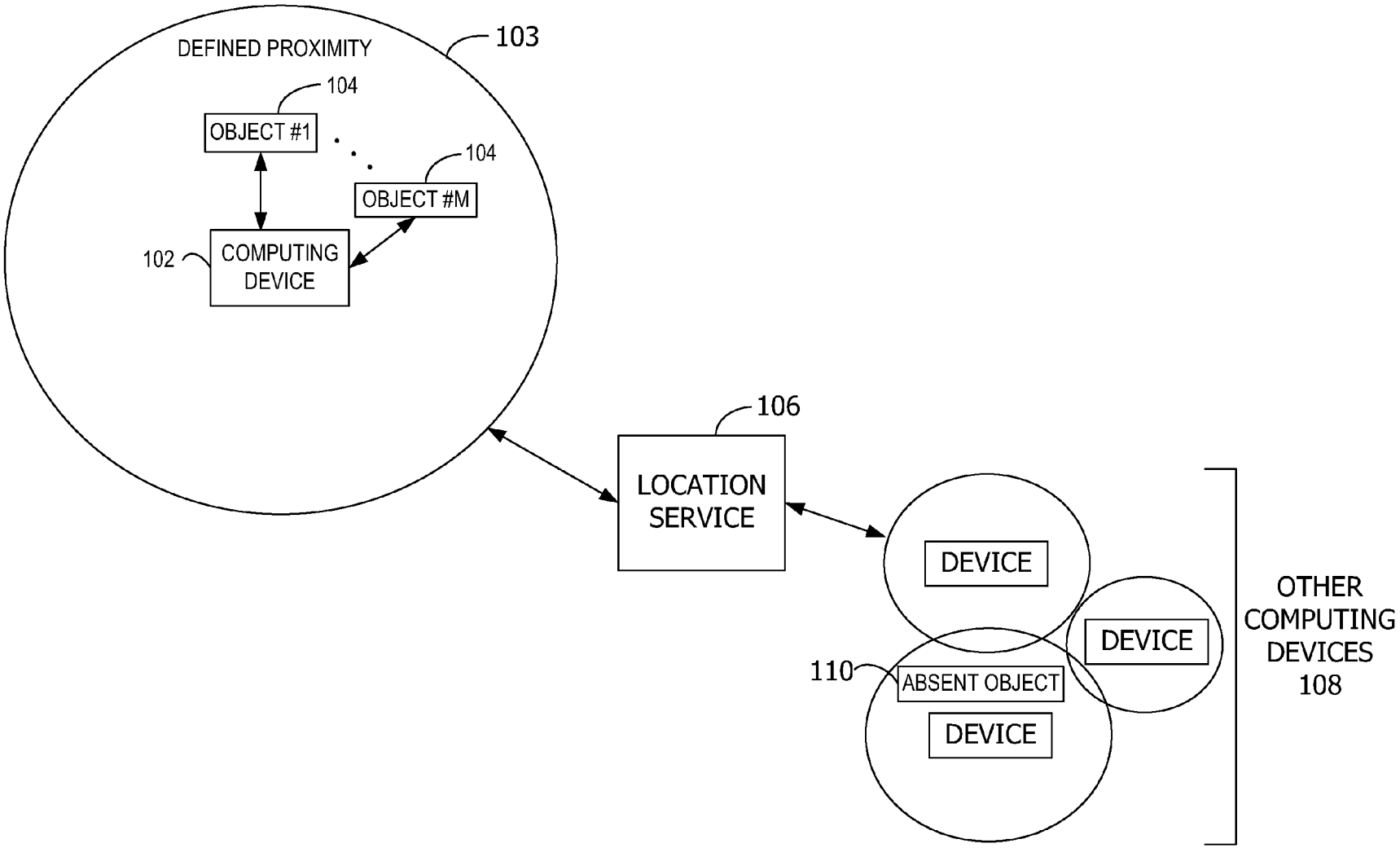
FIG. 1 is an exemplary block diagram illustrating a computing device having objects within a defined proximity.

Referring again to FIG. 1, an exemplary block diagram illustrates a computing device 102 having objects 104 within a defined proximity 103. The elements illustrated in FIG. 1 operate to enable the detection and location of missing objects. The computing device 102 includes any device that is capable of detecting nearby objects 104 such as object #1 through object #M. In the example of FIG. 1, the objects 104 are associated with the computing device 102, referred to as "geotethering." In some embodiments, the computing device 102 represents a plurality of computing devices programmed to implement the functionality described herein. The computing device 102 is enabled with technology such as BLUETOOTH brand wireless communication services, radio frequency identification (RFID), wireless fidelity (Wi-Fi), ZIGBEE brand wireless communication services, and other technologies that enable short-range wireless communication. For example, aspects of the disclosure contemplate thermal or ultrasound communication techniques where each of the "tagged" objects 104 has a unique signature (e.g., a thermal signature or an acoustic signature). Exemplary computing devices 102 include a mobile computing device 502 such as a mobile telephone, a laptop, a desktop computer, a gaming device, or a portable media player.

The size or extent of the proximity 103 is defined by the corresponding wireless communication technology. For example, BLUETOOTH brand wireless communication services typically have an effective range of 10 meters, while RFID may have a read range of up to 100 meters. While the defined proximity 103 in FIG. 1 is illustrated as a generally uniform oval, the shape of the actual proximity may vary at least based on the wireless communication technology and the environment in which the computing device 102 is located.

Figure 2:
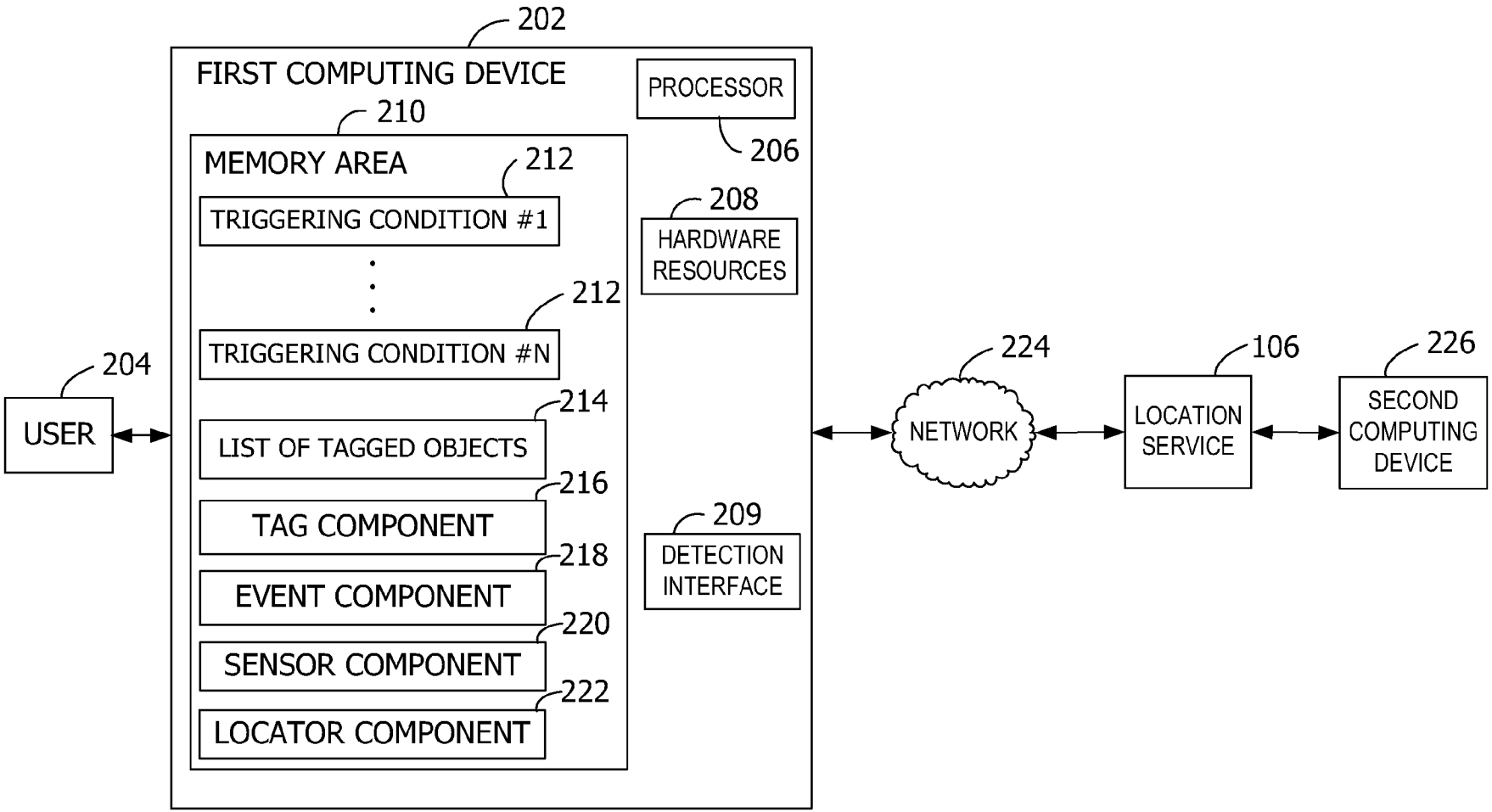
FIG. 2 is an exemplary block diagram illustrating a computing device storing triggering conditions for monitoring the proximity of items to the computing device.

The computing device 102 communicates with a location service 106 via, for example, a network such as network 224 in FIG. 2. In the example of FIG. 1, the location service 106 is illustrated as physically separate from the computing device 102. In other embodiments, the location service 106, or a portion thereof, may execute on the computing device 102. For example, a client portion of the location service 106 executes on the computing device 102 while a server portion or web service portion of the location service 106 executes on another computing device remote from the computing device 102.

The location service 106 maintains the locations of the computing device 102 and other computing devices 108. The other computing devices 108 include one or more computing devices, each possibly having objects within a defined proximity. The location service 106 may maintain the locations in one or more of the following ways: by polling each of the computing devices, by receiving location updates from each of the computing devices, or by assigning locations to each of the computing devices expected to stay within a particular area.

Referring next to FIG. 2, an exemplary block diagram illustrates a first computing device 202 storing triggering conditions 212 for monitoring the proximity of objects 104 to the first computing device 202. In the example of FIG. 2, the first computing device 202 communicates with the location service 106 via network 224 such as the Internet. The network 224 may be wired or wireless. The location service 106 communicates with at least one second computing device 226 to locate missing objects.

The first computing device 202 includes any device capable of wireless item detection such as computing device 102. The first computing device 202 includes at least a memory area 210 and a processor 206. The memory area 210, or other computer-readable media, stores identification of one or more triggering conditions 212 such as triggering condition #1 through triggering condition #N. Each of the triggering conditions 212 is associated with the first computing device 202 (e.g., mobile computing device 502), a group of computing devices, a user such as user 204, a group of users, or the like. The triggering conditions 212 may be defined by the user 204, by the location service 106, by the manufacturer of the first computing device 202, or by other entities. In some embodiments, the triggering conditions 212 are associated with one or more hardware resources 208 of the first computing device 202. Exemplary hardware resources 208 include one or more of the following: an accelerometer, a battery, a camera, a thermometer, a barometer, a moisture sensor, a photosensor, and a microphone.

Exemplary triggering conditions 212 include one or more of the following: time-based transitions, movement of the first computing device 202 (e.g., after a period of inactivity, or orientation of the first computing device 202), connection to a wireless access point, disconnection from a wireless access point, manual activation from the user 204 of the first computing device 202, a location of the first computing device 202 (e.g., a geographic location or an elevation), and a power level of a battery. Exemplary time-based transitions include transitions such as driving to or from work, driving to a particular meeting, or leaving a particular geographic area. The transitions may be stored as appointments or tasks by a calendar service such as online calendar service 410 in FIG. 4. Exemplary triggering conditions 212 that rely on connection or disconnection from a wireless access point include changing connections between cellular network towers. Other exemplary triggering conditions 212 rely on a change in any observed Global System for Mobile (GSM) communications data or code division multiple access (CDMA) data such as location area code (LAC), mobile network code (MNC), mobile country code (MMC), or cell ID.

Exemplary movement of the first computing device 202 includes movement after a period of inactivity (e.g., mobile computing device 502 is picked up by the user 204, or a key is pressed after 10 idle minutes), sudden and rapid movement such as the acceleration of an automobile, or a cessation of movement. Movement, or lack of movement, is detected by, for example, one or more accelerometers in the first computing device 202. Exemplary triggering conditions 212 that rely on location are defined by, for example, a geographic location as determined by a global positioning system (GPS), a user-defined point of interest (e.g., work, home, school, library), an elevation or change in elevation, or the like.

The memory area 210 further stores a list 214 of tagged objects 104 that the first computing device 202 expects to be proximate to the first computing device 202. In operation, the first computing device 202 attempts to detect the tagged objects 104 using a detection interface 209 or other form of sensing platform. The detection interface 209 includes, for example, an RFID reader, a BLUETOOTH brand wireless communication interface, or any other device, component, module, or the like for detecting proximate objects 104. Aspects of the disclosure are operable with any item having a tag that is capable of interrogation and identification by a reader or other detection interface 209.

The list 214 of tagged objects 104 includes objects 104 identified by the user 204 or other users, identified by the location service 106, and/or discovered by the first computing device 202. For example, the user 204 may interact with the first computing device 202 to identify the tagged objects 104 to be included in the list 214 of tagged objects 104. Alternatively or in addition, the first computing device 202 may detect the proximity of one or more tagged objects 104, and prompt the user 204 to include or exclude the detected objects 104 in the list 214 of tagged objects 104. In some embodiments (not shown), the list 214 of tagged objects 104 is stored by an entity remote from the first computing device 202 such as the location service 106. The first computing device 202 may download the list 214 of tagged objects 104 from the remote entity. The memory area 210 may also store an identifier associated with each of the objects 104 in the list 214 of objects 104, and may further store an association between the user 204 and the list 214 of objects 104. The identifier may be defined by aspects of the disclosure, or may be obtained from the item. For example, an RFID tag on one of the objects 104 may already have a previously assigned identifier.

The memory area 210, or one or more computer-readable media, further stores computer-executable components for implementing aspects of the disclosure. Exemplary components include a tag component 216, an event component 218, a sensor component 220, and a locator component 222. These components operate to intelligently monitor tagged objects 104 based on triggering conditions 212 and are described below with reference to FIG. 3.

In general, the memory area 210 is associated with the first computing device 202. For example, in FIG. 2, the memory area 210 is within the first computing device 202. However, the memory area 210 includes any memory area internal to, external to, or accessible by the first computing device 202. Further, the memory area 210 or any of the data stored thereon may be associated with any server or other computer, local or remote from the first computing device 202 (e.g., accessible via a network).

The processor 206 includes any quantity of processing units, and is programmed to execute computer-executable instructions for implementing aspects of the disclosure. The instructions may be performed by the processor 206 or by multiple processors executing within the first computing device 202, or performed by a processor external to the first computing device 202 (e.g., by a cloud service). In some embodiments, the processor 206 is programmed to execute instructions such as those illustrated in the figures (e.g., FIG. 3).

Figure 3:
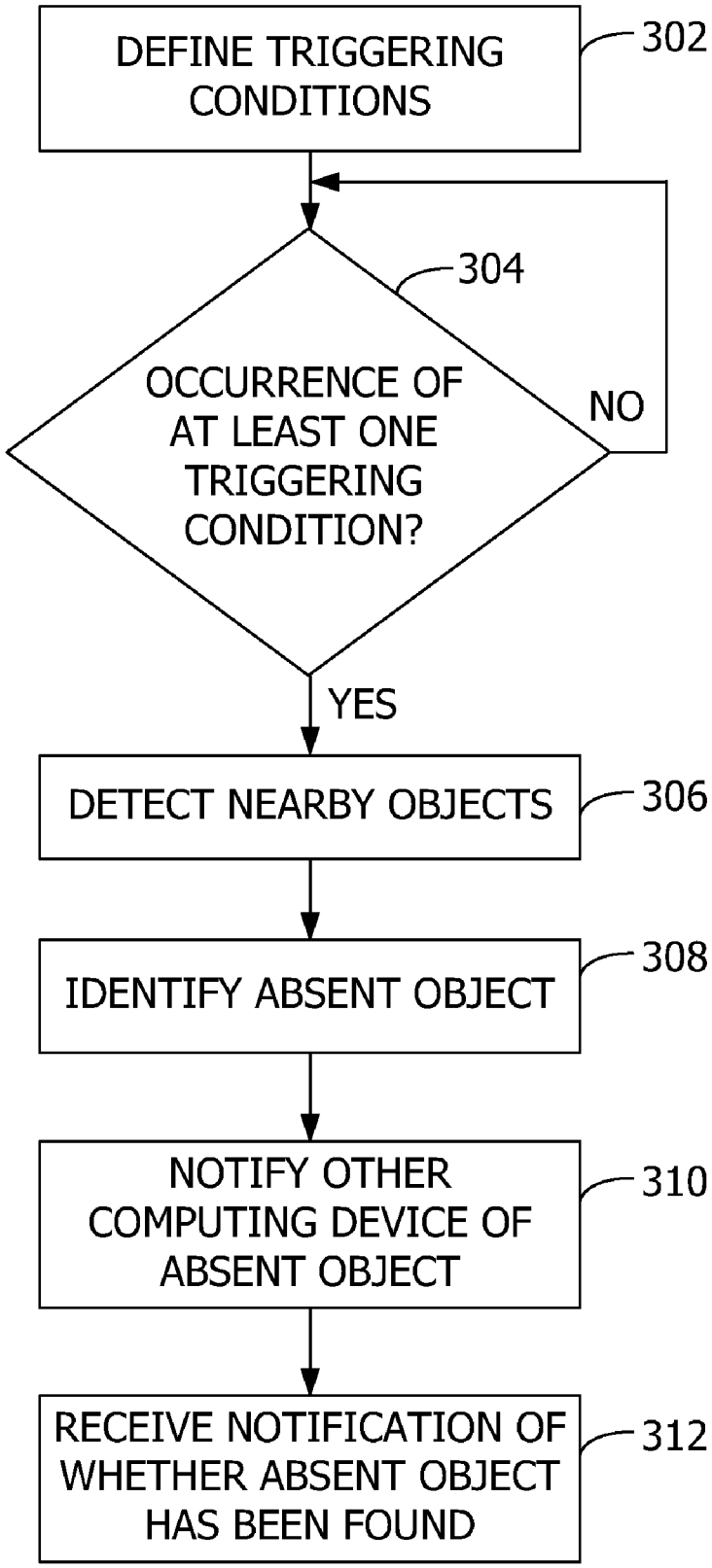
FIG. 3 is an exemplary flow chart illustrating the detection and location of an absent item.

Referring next to FIG. 3, an exemplary flow chart illustrates the detection and location of an absent item. One or more of the triggering conditions 212 associated with the computing device 102 are defined at 302. Upon detection of the occurrence of at least one of the triggering conditions 212 at 304, one or more proximate or nearby objects 104 are detected at 306. In some embodiments, the triggering conditions 212 may also be used to prevent detection of the objects 104. For example, if one of the triggering conditions 212 specifies that detection should not occur (or occur once more only) if the battery level drops below a particular threshold, the computing device 102 disables detection.

The detected objects 104 are compared to the list 214 of objects 104 intended or expected to be proximate to the computing device 102. As a result of the comparison, one or more absent objects 110 are identified at 308. The absent objects 110 are identified to another computing device 108 (e.g., the second computing device 226) at 310. Responsive to receiving identification of the absent objects 110, the second computing device 226 attempts to detect the absent objects 110 proximate to the second computing device 226. The computing device 102 receives a notification at 312 from the second computing device 226 of whether any of the absent objects 110 are proximate to the second computing device 226. Alternatively, the computing device 102 receives a notification only if the second computing device 226 detects at least one of the absent objects 110. In some embodiments, the computing device 102 displays the received notification to the user 204.

In some embodiments, the computing device 102 identifies other computing devices 108 that may be near one of the absent objects 110 by determining possible and probable locations for the absent item. For example, the computing device 102 may determine the last known location of the absent item (e.g., the location during the last successful polling of the absent item), the current location of the computing device 102, and a route or path traveled by the computing device 102 between the last known location and the current location. The computing device 102 then identifies the computing devices that are near the last known location, the current location, and/or along the route in-between, and notifies those computing devices of the absent item. In other embodiments, the computing device 102 (or location service 106) maintains a history of locations where the absent item was found after previously being lost.

Users of the other computing devices 108 may opt in to participate in locating absent or missing objects from other users. In such an embodiment, the users register their participating computing devices with the location service 106. When the location service 106 (or computing device 102) attempts to identify the other computing devices 108 that may be able to locate the absent objects 110, the location service 106 selects from the participating computing devices.

In some embodiments, the other computing device 108 includes a computing device executing the location service 106. In such embodiments, the location service 106 acts as an intermediary for the computing device 102 to identify and communicate with one or more of the second computing devices 226. The location service 106 may also identify, to the computing device 102, the second computing device 226 that has located the missing item. For example, the location service 106 may initiate a chat or instant message session between the computing device 102 and the second computing device 226.

In some embodiments, the operations illustrated in FIG. 3 are performed by the computing device 102. In other embodiments, at least one of the operations is performed by the location service 106 or another entity or device. In such embodiments, the computing device 102 may operate as a thin client that monitors itself for the triggering conditions 212 but otherwise receives data output from performance of the other operations in FIG. 3 by another device. For example, the computing device 102 may be a mobile computing device such as mobile computing device 502 with limited resources that interacts with the location service 106. In this example, the mobile computing device 502 detects proximate objects 104 and identifies the detected objects 104 to the location service 106 that stores the list 214 of objects 104 expected to be proximate to the mobile computing device 502. The location service 106 compares the detected objects 104 to the list 214 of objects 104 to identify at least one absent item. The location service 106 determines other computing devices 108 that may have the absent item nearby, and then identifies the absent item to the determined computing devices. If the determined computing devices detect the absent item, the determined computing device that detected the item, or the location service 106, notifies the mobile computing device 502.

In some embodiments, one or more computer-executable components, such as the components illustrated in FIG. 2, execute on the computing device 102 to perform the operations illustrated in FIG. 3. The tag component 216, when executed by the processor 206, causes the processor 206 to associate an identifier with one of the objects 104 intended to be within the defined proximity 103 of the computing device 102. The event component 218, when executed by the processor 206, causes the processor 206 to selectively monitor the object 104 based on the occurrence of one or more of the triggering conditions 212. In some embodiments, the event component 218 defines the triggering conditions 212 based in part on the location of the computing device 102. For example, the triggering conditions 212 may vary based on whether the computing device 102 is at a workplace of the user 204 (e.g., poll for the objects 104 every time the mobile computing device 502 senses movement) or at a residence of the user 204 (e.g., poll for the objects 104 only when the mobile computing device 502 leaves the house). In some embodiments, the event component 218 defines the triggering conditions 212 based in part on the quantity of objects 104 to be monitored. For example, if a small quantity of objects 104 are to be monitored, the event component 218 may define the triggering conditions 212 such that occurrence of the conditions is more frequent. Conversely, if a large quantity of objects 104 are to be monitored, the event component 218 may define the triggering conditions 212 such that occurrence of the conditions is less frequent. In this example, the event component 218 selectively monitors the objects 104 based in part on a remaining power level of the computing device 102.

The sensor component 220, when executed by the processor 206, causes the processor 206 to detect the absence of the monitored object 104 within the defined proximity 103. For example, the sensor component 220 monitors the object 104 via a radio frequency signal communicated between the computing device 102 and the object 104. The locator component 222, when executed by the processor 206, causes the processor 206 to identify the absence of the monitored object 104 to the location service 106. The location service 106 identifies a plurality of devices within, for example, a geographic area of the computing device 102. If at least one of the plurality of devices detects the monitored object 104, the location service 106 or the device notifies the locator component 222.

Figure 4:
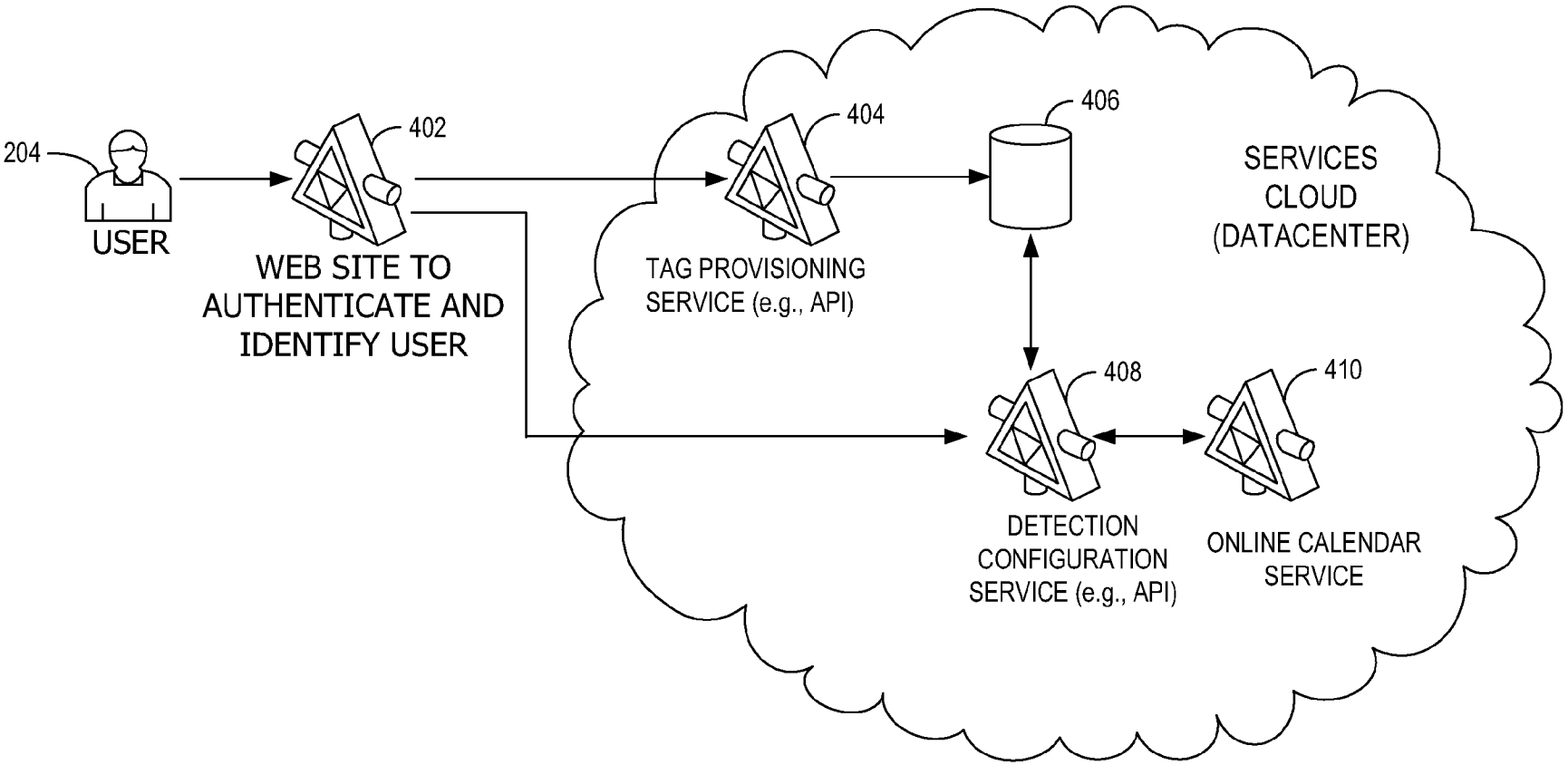
FIG. 4 is an exemplary block diagram illustrating the creation of tag associations with objects and the creation of time-based triggering conditions.

Referring next to FIG. 4, an exemplary block diagram illustrates the creation of tag associations with objects 104 and the creation of time-based triggering conditions 212. In the example of FIG. 4, the user 204 interacts with a web site 402 that identifies and authenticates the user 204. After authentication, the user 204 interacts with a tag provisioning service 404. The user 204 identifies objects 104 for tagging, and the tag provisioning service 404 defines an identifier for association therewith. For example, the user 204 identifies a wallet, keys, laptop, purse, and/or a portable music player. The tag provisioning service 404 creates identifiers for each of the objects 104, or obtains the identifiers by querying the objects 104 (e.g., some objects 104 may also have an identifier such as some RFID tags). The tag provisioning service 404 stores the identifiers and associations in a database 406 or other memory storage area. The user 204 may also interact with a detection configuration service 408 to define the triggering conditions 212. In the example of FIG. 4, the detection configuration service 408 interacts with the online calendar service 410 to store or obtain time-based triggering conditions 212. In some embodiments (not shown), the online calendar service 410 stores the time-based triggering conditions 212 in the database 406.

The database 406 may also store a state associated with each of the tagged objects 104. For example, the state may be "present" or "absent" depending on the results of the latest poll by the computing device 102.

Both the tag provisioning service 404 and the detection configuration service 408 execute in a services cloud (e.g., datacenter) in FIG. 4. In other embodiments (not shown), one or both of these services execute elsewhere. For example, either or both service may execute on the computing device 102 of the user 204. Alternatively or in addition, the services may provide application programming interfaces (APIs) enabling other application programs to provide the functionality of the services to the user 204. These application programs may execute on the computing device 102 of the user 204, or on other computing devices (e.g., kiosks, web servers, etc.).

Figure 5:
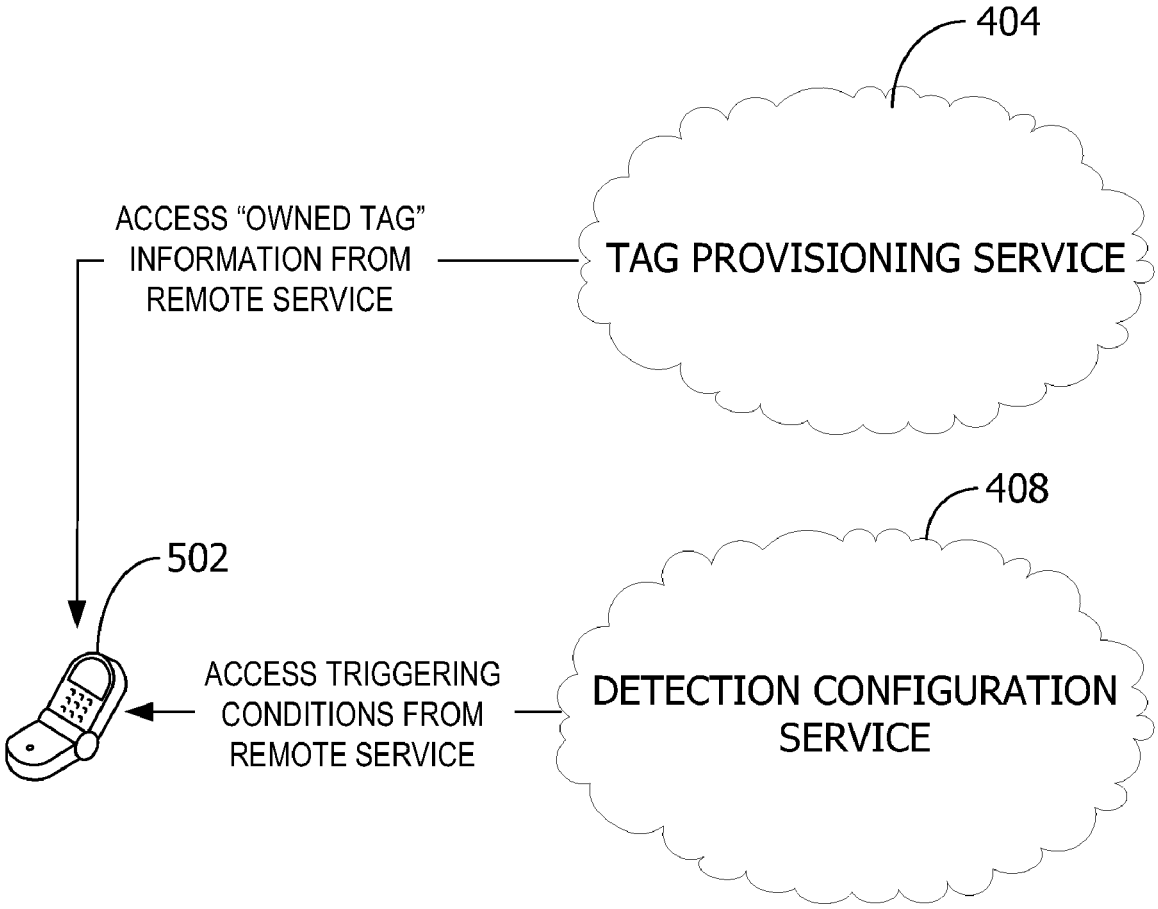
FIG. 5 is an exemplary block diagram illustrating initialization of an application program for monitoring objects within a defined proximity of a mobile computing device.

Referring next to FIG. 5, an exemplary block diagram illustrates initialization of an application program for monitoring objects 104 within a defined proximity of the mobile computing device 502. The application program executes on the mobile computing device 502 to access, from the tag provisioning service 404, the list 214 of tagged objects 104 expected to be proximate to the mobile computing device 502. The application program further executes to access the triggering conditions 212 from the detection configuration service 408.

While the mobile computing device 502 is illustrated in FIG. 5 as a mobile telephone, the mobile computing device 502 may be any mobile computing device as contemplated in the art.

In the example of FIG. 4 and FIG. 5, the tag provisioning service 404 and the detection configuration service 408 are shown as separate entities. In other embodiments, however, the functionality of the tag provisioning service 404 and the detection configuration service 408 is provided by a single entity (e.g., a single application programs or combined set of APIs).

Further Examples

Various implementations of the disclosure are contemplated. For example, embodiments of the disclosure include the user 204 defining the triggering conditions 212 to cover the following conditions: poll for the objects 104 when the user 204 leaves a residence, when the user 204 leaves a workplace, and when the user 204 enters an airport. In such examples, embodiments of the disclosure operate to remind the user 204 in a timely manner of any missing objects 104.

Embodiments of the disclosure operate to provide battery-efficient "geofencing" relative to the computing device 102. When any of the objects 104 move beyond a perimeter relative to the computing device 102 and at least one of the triggering conditions 212 is triggered, the missing objects are detected and the user 204 is alerted.

In some embodiments, the power savings achieved by the selective polling depend upon a frequency of occurrence of the triggering conditions 212. The relationship between polling events and power savings may be linear, exponential, or otherwise related. In a prophetic example, by reducing the polling frequency by 25%, the corresponding power savings may be 25%. In another prophetic example, depending on the computing device 102 and hardware or software configuration therein, the power savings may be greater than 25% when the polling frequency is reduced by 25%.

Exemplary Operating Environment

By way of example and not limitation, computer readable media comprise computer storage media and communication media. Computer storage media store information such as computer readable instructions, data structures, program modules or other data. Communication media typically embody computer readable instructions, data structures, program modules, or other data in a modulated data signal such as a carrier wave or other transport mechanism and include any information delivery media. Combinations of any of the above are also included within the scope of computer readable media.

Although described in connection with an exemplary computing system environment, embodiments of the invention are operational with numerous other general purpose or special purpose computing system environments or configurations. Examples of well known computing systems, environments, and/or configurations that may be suitable for use with aspects of the invention include, but are not limited to, mobile computing devices, personal computers, server computers, hand-held or laptop devices, multiprocessor systems, gaming consoles, microprocessor-based systems, set top boxes, programmable consumer electronics, mobile telephones, network PCs, minicomputers, mainframe computers, distributed computing environments that include any of the above systems or devices, and the like.

Embodiments of the invention may be described in the general context of computer-executable instructions, such as program modules, executed by one or more computers or other devices. The computer-executable instructions may be organized into one or more computer-executable components or modules. Generally, program modules include, but are not limited to, routines, programs, objects, components, and data structures that perform particular tasks 310 or implement particular abstract data types. Aspects of the invention may be implemented with any number and organization of such components or modules. For example, aspects of the invention are not limited to the specific computer-executable instructions or the specific components or modules illustrated in the figures and described herein. Other embodiments of the invention may include different computer-executable instructions or components having more or less functionality than illustrated and described herein.

Aspects of the invention transform a general-purpose computer into a special-purpose computing device when configured to execute the instructions described herein.

The embodiments illustrated and described herein as well as embodiments not specifically described herein but within the scope of aspects of the invention constitute exemplary means for locating the absent object 110, and exemplary means for defining the triggering conditions 212 to preserve battery life on the mobile computing device 502.

The order of execution or performance of the operations in embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

What is claimed is:

1. A system for intelligent monitoring of tagged objects based on triggering conditions, said system comprising:

a memory area for storing identification of one or more triggering conditions, each of the triggering conditions being associated with a user of a mobile computing device; and a processor programmed to:

monitor the mobile computing device for occurrence of at least one of the triggering conditions identified in the memory area;

responsive to occurrence of at least one of the triggering conditions, detect one or more objects proximate to the mobile computing device;

identify the detected objects to a location service, wherein the location service compares the detected objects to objects intended to be proximate to the mobile computing device to identify at least one absent object, wherein the location service identifies the absent object to at least one other computing device, wherein the other computing device attempts to detect the absent object proximate to the other computing device;

receive, by the mobile computing device, a notification of whether the absent object is proximate to the other computing device; and provide the received notification to the user of the mobile computing device.

2. The system of claim 1, wherein the processor is programmed to receive the notification from the location service.

3. The system of claim 1, wherein the processor is programmed to receive the notification from the other computing device.

4. The system of claim 1, wherein the memory area further stores a list of the objects intended to be proximate to the mobile computing device.

5. The system of claim 4, wherein the memory area further stores an identifier associated with each of the objects in the list of objects, and wherein the memory area further stores an association between a user of the mobile computing device and the list of objects.

6. The system of claim 1, further comprising means for locating the absent object.

7. The system of claim 1, further comprising means for defining the triggering conditions to preserve battery life on the mobile computing device.

8. A method comprising:

defining triggering conditions associated with a first computing device;

detecting, by a first computing device responsive to an occurrence of at least one of the triggering conditions, one or more items proximate to the first computing device;

comparing the detected items to a list of items intended to be proximate to the first computing device to identify at least one absent item;

identifying the absent item to a second computing device, wherein the second computing device attempts to detect the absent item proximate to the second computing device; and receiving, by the first computing device from the second computing device, a notification of whether the absent item is proximate to the second computing device.

9. The method of claim 8, further comprising defining the list of items based on input from a user of the first computing device.

10. The method of claim 8, further comprising notifying a user of the first computing device of the received notification.

11. The method of claim 8, wherein identifying the absent item comprises identifying the absent item to a plurality of second computing devices via a network connecting the first computing device with the plurality of second computing devices.

12. The method of claim 8, wherein identifying the absent item comprises identifying the absent item to a remote server, wherein the remote server identifies the absent item to the second computing device.

13. The method of claim 8, wherein comparing the detected items to the list of items comprises identifying the detected items to a remote server for comparison to the list of items intended to be proximate to the first computing device.

14. The method of claim 8, further comprising monitoring the first computing device for occurrence of at least one of the triggering conditions.

15. The method of claim 8, wherein defining the triggering conditions comprises defining the triggering conditions to include one or more of the following: time-based transitions, movement of the first computing device after a period of inactivity, connection to a wireless access point, disconnection from a wireless access point, manual activation from a user of the first computing device, and a location of the first computing device.

16. One or more computer storage media having computer-executable components, said components comprising:

a tag component that when executed by at least one processor causes the at least one processor to associate an identifier with an object intended to be within a defined proximity of a computing device;

an event component that when executed by at least one processor causes the at least one processor to selectively monitor the object based on occurrence of one or more triggering conditions, said triggering conditions being associated with the computing device;

a sensor component that when executed by at least one processor causes the at least one processor to detect the absence of the monitored object within the defined proximity; and a locator component that when executed by at least one processor causes the at least one processor to identify the absence of the monitored object to a location service, wherein the location service identifies a plurality of devices within a geographic area of the computing device, wherein at least one of the plurality of devices detects the monitored object, and wherein the locator component receives a notification from the location service or from said at least one of the plurality of devices of the detection of the monitored object.

17. The computer storage media of claim 16, wherein the sensor component monitors the object via a radio frequency signal communicated between the computing device and the object.

18. The computer storage media of claim 16, wherein the event component further defines the triggering conditions based in part on a location of the computing device.

19. The computer storage media of claim 16, wherein the event component selectively monitors the object based in part on a remaining power level of the computing device.

20. The computer storage media of claim 16, wherein the event component further defines the triggering conditions based in part on a quantity of objects to be monitored.

* * * * *